US009033459B2

(12) United States Patent
Yamamoto

(10) Patent No.: US 9,033,459 B2
(45) Date of Patent: May 19, 2015

(54) INKJET PRINTING APPARATUS AND A PURGING METHOD THEREFOR

(75) Inventor: Takaharu Yamamoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 116 days.

(21) Appl. No.: 13/621,053

(22) Filed: Sep. 15, 2012

(65) Prior Publication Data

US 2013/0076829 A1 Mar. 28, 2013

(30) Foreign Application Priority Data

Sep. 27, 2011 (JP) ..... 2011-210827

(51) Int. Cl.
*B41J 2/165* (2006.01)
*B41J 2/175* (2006.01)
*B41J 2/19* (2006.01)

(52) U.S. Cl.
CPC ..... *B41J 2/16585* (2013.01); *B41J 2/16523* (2013.01); *B41J 2/16532* (2013.01); *B41J 2/17596* (2013.01); *B41J 2/19* (2013.01)

(58) Field of Classification Search
None
See application file for complete search history.

(56) References Cited

U.S. PATENT DOCUMENTS

| | | | | |
|---|---|---|---|---|
| 6,164,752 | A | 12/2000 | Schaefer et al. | |
| 2002/0109747 | A1 | 8/2002 | Premnath et al. | |
| 2004/0137159 | A1 | 7/2004 | Nakamura et al. | |
| 2005/0057603 | A1 * | 3/2005 | Hirakata et al. | 347/30 |
| 2006/0055728 | A1 * | 3/2006 | Nishino | 347/30 |
| 2009/0147038 | A1 | 6/2009 | Tsukada | |
| 2010/0053258 | A1 | 3/2010 | Seino et al. | |
| 2012/0050358 | A1 * | 3/2012 | Kitabatake et al. | 347/6 |

FOREIGN PATENT DOCUMENTS

| | | |
|---|---|---|
| EP | 1693209 A2 | 8/2006 |
| JP | 2010-058303 A | 3/2010 |
| JP | 4687063 | 2/2011 |

OTHER PUBLICATIONS

European Search Report issued in European Patent Application No. 12182866.9 dated Jan. 10, 2013.

* cited by examiner

*Primary Examiner* — Alejandro Valencia
(74) *Attorney, Agent, or Firm* — McDermott Will & Emery LLP

(57) ABSTRACT

An inkjet printing apparatus carries out printing by moving an inkjet head and printing paper relative to each other. The inkjet head has a plurality of nozzles for discharging ink droplets. The apparatus includes a feed pipe connected to each nozzle of the inkjet head for feeding ink thereto, an ink feed control valve mounted on the feed pipe for controlling circulation of the ink, a cap for blocking the plurality of nozzles of the inkjet head, a decompression device for decompressing an inside of the cap, decompression piping for connecting the cap and the decompression device, a decompression control valve mounted on the decompression piping for controlling communication between the cap and the decompression device, and a controller.

6 Claims, 4 Drawing Sheets

INKJET PRINTING APPARATUS AND A PURGING METHOD THEREFOR

BACKGROUND OF THE INVENTION (1) Field of the Invention

This invention relates to an inkjet printing apparatus for printing on printing paper by discharging ink droplets from an inkjet head while moving the inkjet head and the printing paper relative to each other, and to a purging method therefor.

(2) Description of the Related Art

An inkjet printing apparatus performs printing by applying ink to printing paper from an inkjet head spaced from the printing paper. With printing resolution becoming higher, a plurality of nozzles of the inkjet head have an increasingly refined structure. This has resulted in an increased possibility of the nozzles getting clogged (non-discharge of ink droplets). Clogging of the nozzles is caused by the ink droplets plugging up the nozzles, or bubbles entering feed paths of the ink droplets. One method of eliminating the clogging consists in what is called purging, which is carried out by attaching a cap to the nozzles of the inkjet head, and placing the inside of the cap in negative pressure, thereby to eliminate the nozzle clogging.

With such purging, while the ink droplets plugging up the nozzles can be removed, it is difficult to remove the bubbles having entered the feed paths. So, "choke suction" has been proposed as a technique for removing also the bubbles having entered the feed paths.

A first apparatus for carrying out this type of choke suction includes a plurality of feed pipes connecting nozzles of an inkjet head and an ink tank, and a choke mechanism disposed upstream of ink supply to each feed pipe of the inkjet head. See Japanese Patent No. 4687063 (paragraph "0029"), for example.

With this first apparatus, after closing the feed pipes with the choke mechanism, the inside of a cap attached to the inkjet head is placed in negative pressure. Thereafter, ink feed pressure is raised at a rapid rate to open the choke mechanism. This discharges the ink at a burst from the feed pipes through the nozzles.

A second apparatus for carrying out choke suction has a plurality of feed pipes connecting an inkjet head and an ink tank, and a diaphragm pump mounted on each feed pipe. See Japanese Unexamined Patent Publication No. 2010-58303 (paragraphs "0086" and "0094" to "0099"), for example.

With this second apparatus, when carrying out a choke cleaning operation, ink is filled into pump chambers of the diaphragm pumps, and then a cap is attached to close nozzles of the inkjet head. The inside of the cap is placed in negative pressure by suction, and the diaphragm pumps are operated to force-feed the ink filling the pump chambers and discharge it from the nozzles. This discharges the ink at a burst from the feed pipes through the nozzles.

However, the conventional examples with such constructions have the following programs.

With the first conventional apparatus, it is necessary to raise the ink feed pressure at a rapid rate in advance of opening the choke mechanism. This poses problems of complicating control and consuming the ink excessively.

The second conventional apparatus requires the diaphragm pumps mounted on the feed pipes, which leads to a complicated construction and a cost increase. It is also necessary to control the diaphragm pumps, resulting in complicated control. Besides, there is again a problem of consuming the ink excessively.

SUMMARY OF THE INVENTION

This invention has been made having regard to the state of the art noted above, and its object is to provide an inkjet printing apparatus and a purging method therefore, which can reduce ink consumption while choke suction is carried out by simple control.

The above object is fulfilled, according to this invention, by an inkjet printing apparatus for carrying out printing by moving an inkjet head and printing paper relative to each other, the inkjet head having a plurality of nozzles for discharging ink droplets, the apparatus comprising a feed pipe connected to each nozzle of the inkjet head for feeding ink thereto; an ink feed control valve mounted on the feed pipe for controlling circulation of the ink; a cap for blocking the plurality of nozzles of the inkjet head; a decompression device for decompressing an inside of the cap; decompression piping for connecting the cap and the decompression device; a decompression control valve mounted on the decompression piping for controlling communication between the cap and the decompression device; and a control device for moving the cap into contact with the inkjet head to block all the nozzles of the inkjet head, then closing the ink feed control valve and the decompression control valve, operating the decompression device, thereafter opening the decompression control valve to decompress the inside of the cap, opening the ink feed control valve, closing the ink feed control valve upon lapse of a predetermined time thereafter, then closing the decompression control valve, stopping the decompression device, and separating the cap from the inkjet head.

According to this invention, the control device, after moving the cap into contact with the inkjet head, closes the ink feed control valve and decompression control valve, and operates the decompression device. Then, the control device opens the decompression control valve to decompress the inside of the cap. In this state, the ink is in the state of choke suction in which the negative pressure forces the ink toward the cap. When the ink feed control valve is opened in this state, the ink will be discharged at a burst into the cap along with bubbles. After closing the ink feed control valve following the predetermined time, the decompression control valve is closed and the decompression device is stopped, thereby to return the inside of the cap to atmospheric pressure. Then, the cap is moved away from the inkjet head. This series of operations is constituted mainly of operation timing of the ink feed control valve, decompression control valve, and decompression device, thereby realizing the choke suction with ease. Since the ink feed control valve is closed upon lapse of the predetermined time after ink discharge, a wasteful discharge of the ink can be inhibited and ink consumption can be reduced.

In this invention, the predetermined time may be set, by taking characteristics of the ink and flow paths into account, to a time for allowing bubbles to be discharged along with the ink.

The ink feed control valve is closed upon lapse of the predetermined time after the ink begins to be discharged. The predetermined time is variable with the viscosity of the ink and resistances of flow paths through which the ink circulates. Therefore, experiment is conducted beforehand to measure a time taken until the bubbles included in the ink are discharged, and this time is set as the predetermined time. This measure can reliably discharge the bubbles included in the ink, and inhibit ink consumption.

In this invention, the decompression control valve may comprise a three-way valve for switching to and from the communication between the cap and the decompression device and communication between the cap and atmosphere, the apparatus further comprising a leak valve disposed on an atmospheric side for returning the inside of the cap to atmospheric pressure at low speed when switching is made to the communication between the cap and atmosphere.

When the inside of the cap is quickly returned to atmospheric pressure by the decompression control valve after ink discharge, the inside of the inkjet head can be adversely affected by the ink blown up from the cap or air mixing into the ink. So, the three-way valve is used as the decompression control valve, and the leak valve is disposed on the atmospheric side. The above inconvenience can be avoided by opening to atmospheric pressure at low speed.

In another aspect of the invention, there is provided a purging method for an inkjet printing apparatus which carries out printing by moving an inkjet head and printing paper relative to each other, the method comprising the steps of moving a cap into contact with the inkjet head to block all nozzles of the inkjet head; closing an ink feed control valve mounted on a feed pipe connected to each nozzle of the inkjet head for feeding ink thereto, the ink feed control valve controlling circulation of the ink, and a decompression control valve mounted on decompression piping connecting the cap and a decompression device for decompressing an inside of the cap, the decompression control valve controlling communication between the cap and the decompression device; operating the decompression device; opening the decompression control valve to decompress the inside of the cap; opening the ink feed control valve; closing the ink feed control valve upon lapse of a predetermined time; closing the decompression control valve, and stopping the decompression device; and separating the cap from the inkjet head.

According to this invention, the decompression device is operated in a state of the cap placed in contact with the inkjet head, and both of the ink feed control valve and decompression control valve closed. This places the ink in a state of choke suction in which negative pressure forces the ink toward the cap. When the ink feed control valve is opened to decompress the inside of the cap, the ink will be discharged at a burst into the cap along with bubbles. After the predetermined time, the ink feed control valve is closed, the decompression device is stopped, and the cap is moved away from the inkjet head. This series of operations is constituted mainly of operation timing of the ink feed control valve, decompression control valve, and decompression device, thereby realizing the choke suction with ease. Since the ink feed control valve is closed upon lapse of the predetermined time after ink discharge, a wasteful discharge of the ink can be inhibited and ink consumption can be reduced.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

One embodiment of this invention will be described hereinafter with reference to the drawings.

Figure 1:
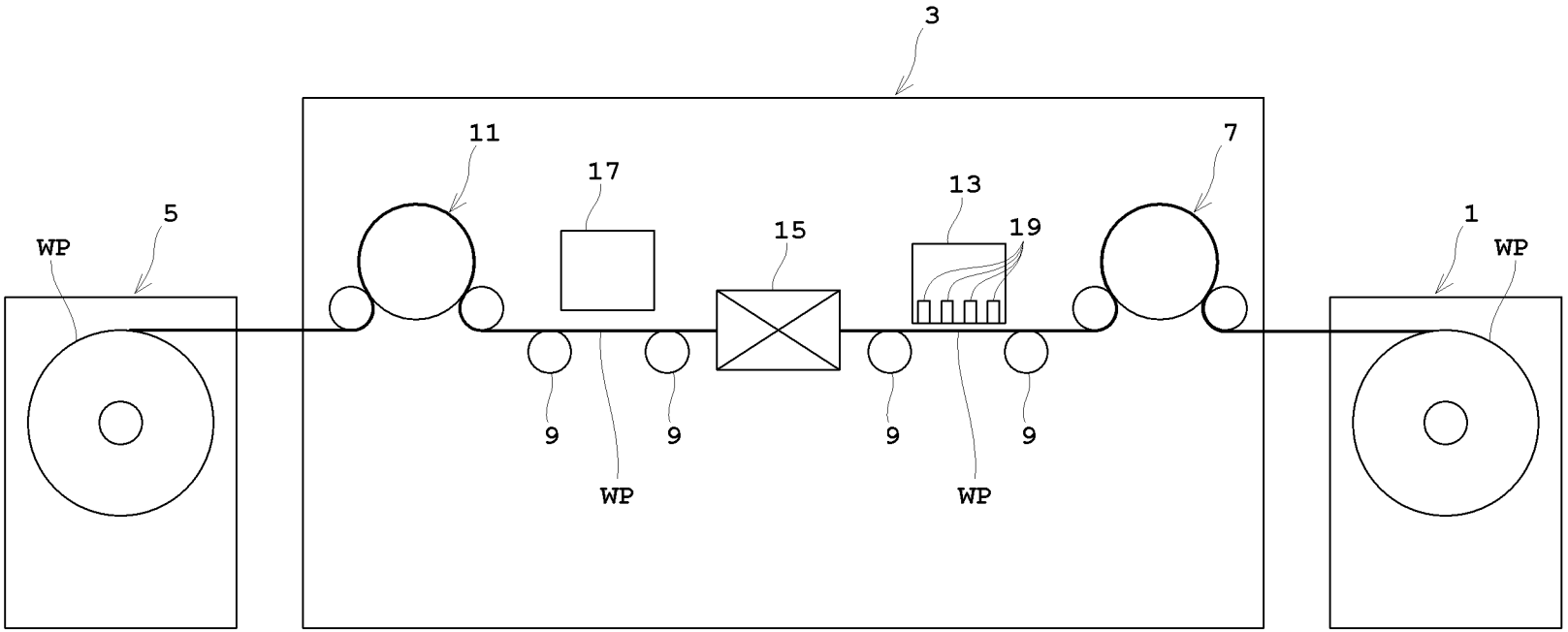
FIG. 1 is a schematic view showing an entire inkjet printing system according to this invention.

FIG. 1 is a schematic view showing an entire inkjet printing system according to this invention. The inkjet printing system according to this invention includes a paper feeder 1, an inkjet printing apparatus 3, and a paper discharger 5. The paper feeder 1 feeds web paper WP stored in a roll form as a printing medium, for example. The inkjet printing apparatus 3 performs printing on the web paper WP fed thereto. The paper discharger 5 winds up printed web paper WP in a roll form.

The paper feeder 1 holds the web paper WP in the roll form to be rotatable about a horizontal axis, and unwinds the web paper WP to feed it to the inkjet printing apparatus 3. The paper discharger 5 winds up the web paper WP printed by the inkjet printing apparatus 3 about a horizontal axis. Regarding the side from which the web paper WP is fed as upstream and the side to which the web paper WP is discharged as downstream, the paper feeder 1 is disposed upstream of the inkjet printing apparatus 3 while the paper discharger 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the paper discharger 5 along a plurality of transport rollers 9. A drive roller 11 is disposed between the most downstream transport roller 9 and the paper discharger 5. This drive roller 11 feeds the web paper WP advancing on the transport rollers 9 toward the paper discharger 5.

Between the drive roller 7 and drive roller 11, the inkjet printing apparatus 3 has a printing unit 13, a drying unit 15, and an inspecting unit 17 arranged in order from upstream to downstream. The drying unit 15 dries portions printed by the printing unit 13. The inspecting unit 17 inspects the printed portions for any stains or omissions.

The printing unit 13 has inkjet heads 19 for discharging ink droplets. Generally, a plurality of printing units 13 are arranged along the transport direction of the web paper WP. For example, four printing units 13 are provided separately for black (K), cyan (C), magenta (M), and yellow (Y). However, in order to facilitate understanding of the invention, the following description will be made on an assumption that only one printing unit 13 is provided. The printing unit 13 has a plurality of inkjet heads 19 arranged also in a horizontal direction (width direction) perpendicular to the transport direction of the web paper WP. The printing unit 13 has enough inkjet heads 19 arranged also in the width direction of the web paper WP to perform printing without moving over a printing area in the width direction of the web paper WP. That is, the inkjet printing apparatus 3 in this embodiment performs printing on the web paper WP being fed thereto, with the inkjet heads 19 not moving for primary scanning, but remaining stationary, in the horizontal direction perpendicular to the transport direction of the web paper WP. This mode is called one-pass mode.

Figure 2:
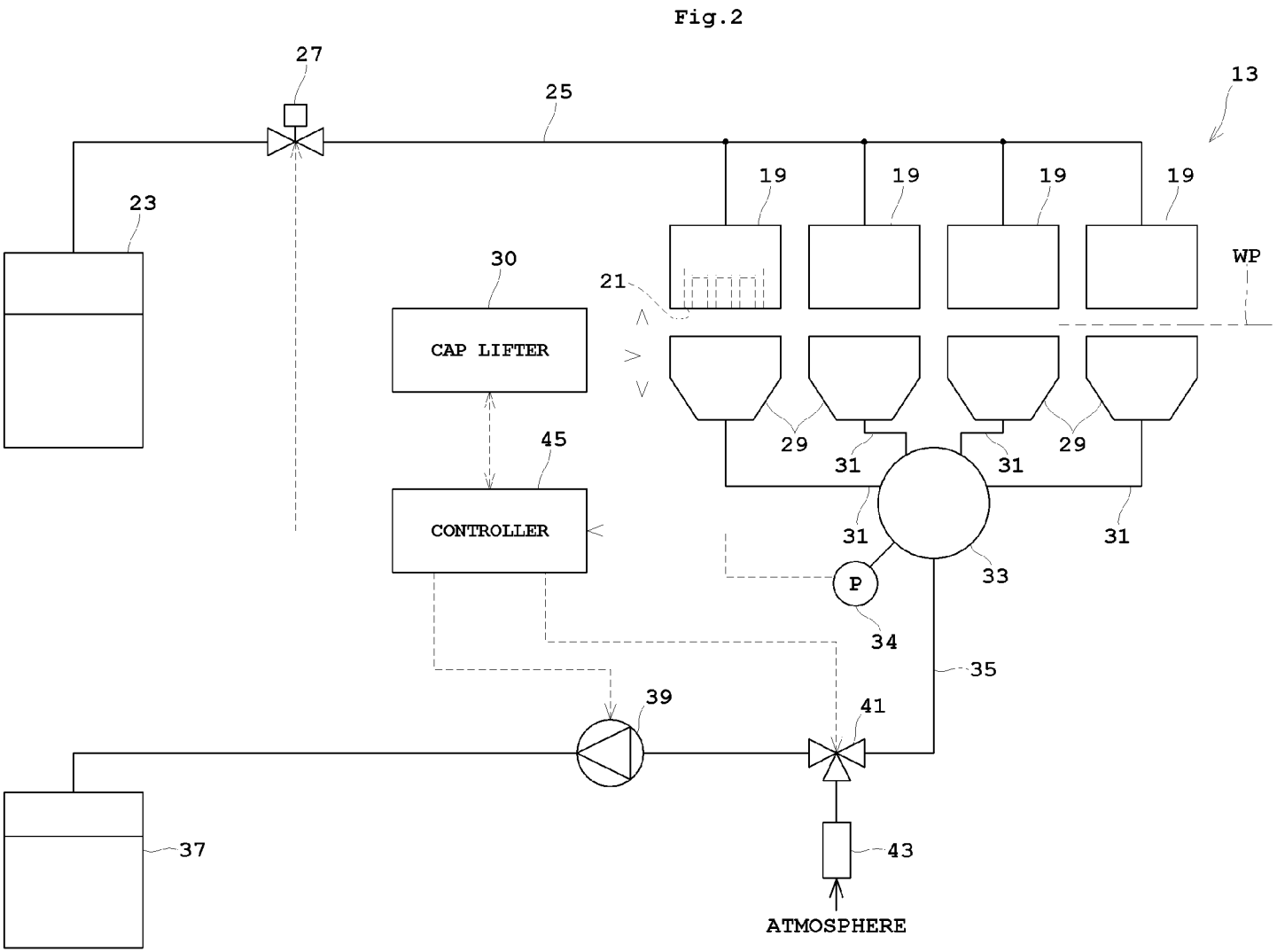
FIG. 2 is a block diagram showing a control system for inkjet heads and adjacent components.

The printing unit 13 will now be described with reference to FIG. 2. FIG. 2 is a block diagram showing a control system for inkjet heads and adjacent components.

The printing unit 13 has a plurality of inkjet heads 19. Each inkjet head 19 has, on a lower surface thereof, a plurality of nozzles 21 arranged in the transport direction of the web paper WP and in a horizontal direction perpendicular to the transport direction (in a direction perpendicular to the plane of FIG. 2).

A main ink tank 23 stores ink for discharging from each nozzle 21 of the inkjet heads 19. Each inkjet head 19 and the main ink tank 23 are connected for communication with each other through a feed pipe 25. The ink in the main ink tank 23 is fed to the feed pipe 25, for example, by compressing an interior of the tank 23, or by drawing the ink from the tank 23 with a pump not shown. The feed pipe 25 has an ink feed control valve 27 for controlling circulation of the ink, which is mounted on a common portion of the feed pipe 25 having branches thereof extending from the respective inkjet heads 19.

Under each inkjet head 19, a cap 29 is disposed to cover all the nozzles 21 of each inkjet head 19. Each cap 29 is vertically movable between a "retracted position" shown in FIG. 2 and a "blocking position" for blocking all the nozzles 21 of each inkjet head 19. Each cap 29 is vertically moved by a cap lifter 30.

Each cap 29 is connected to an accumulator 33 through a purge branch pipe 31. The accumulator 33 is connected to a waste tank 37 through purge piping 35. The accumulator 33 has a pressure gauge 34 attached thereto for measuring internal pressure. The purge piping 35 has a diaphragm pump 39 and a three-way valve 41 mounted thereon. The diaphragm pump 39 decompresses the inside of each cap 29 through the purge branch pipe 31, accumulator 33, and purge piping 35. The three-way valve 41 is connected to the diaphragm pump 39, an atmospheric opening side, and the accumulator 33, and switches the communication with the accumulator 33 to and from the diaphragm pump 39 and the atmospheric opening side. A leak valve 43 is provided on the atmospheric opening side from the three-way valve 41. This leak valve 43 permits circulation of air only from the atmosphere opening side to the purge piping 35. The leak valve 43 is set to provide a lower flow velocity of air than when simply opened.

The purge branch pipes 31, accumulator 33, and purge piping 35 correspond to the "decompression piping" in this invention. The diaphragm pump 39 corresponds to the "decompression device" in this invention. The three-way valve 41 corresponds to the "decompression control valve" in this invention.

The ink feed control valve 27, cap lifter 30, diaphragm pump 39, and three-way valve 41 are operable under overall control of a controller 45. The controller 45 has, built therein, a CPU, memory, a timer, and so on not shown. The memory not shown has, stored therein beforehand, a predetermined time T1 to be described hereinafter. Measurements of the pressure gauge 34 are read by the controller 45.

Figure 3:
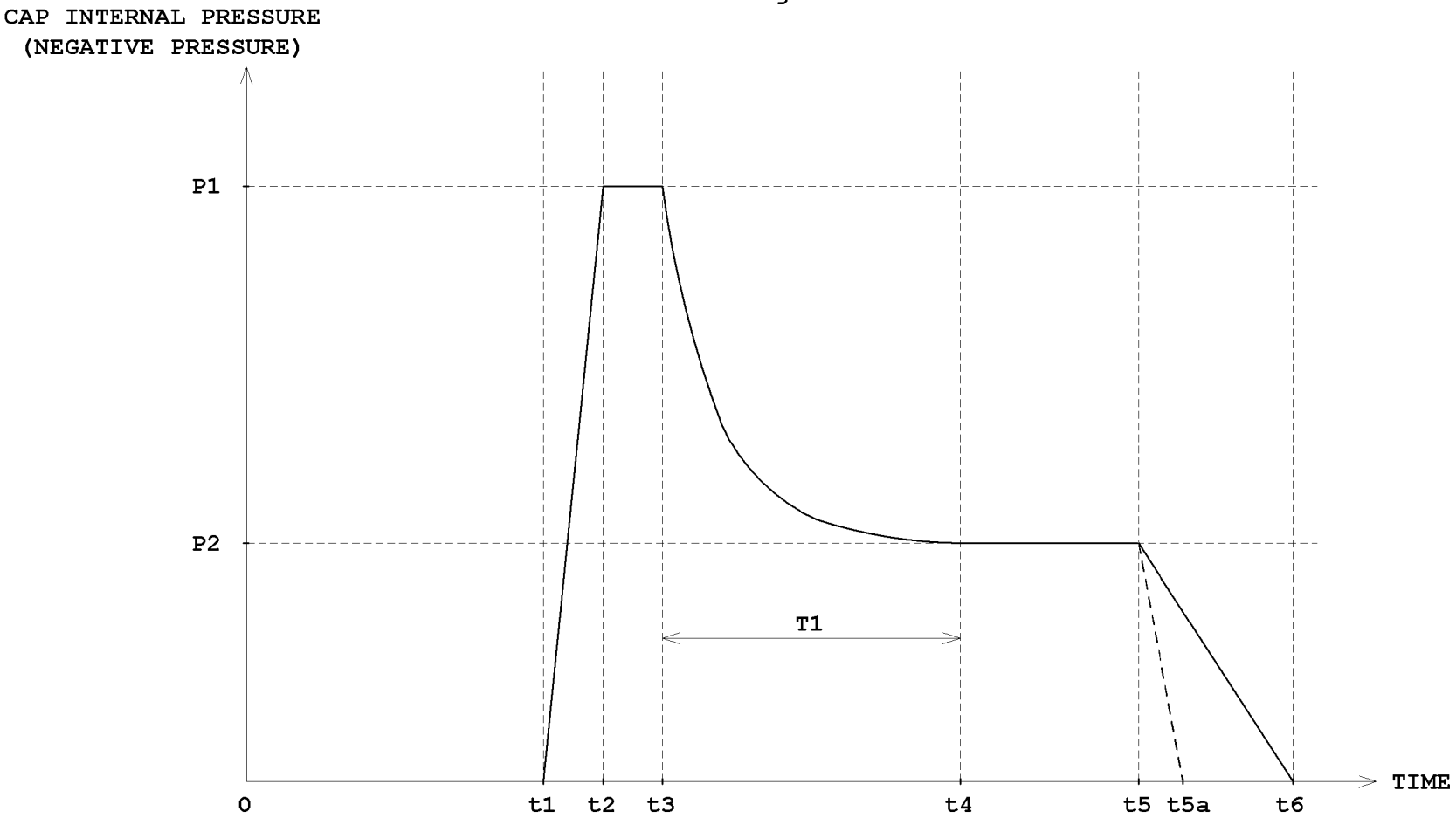
FIG. 3 is a graph showing pressure variations in caps.
Figure 4:
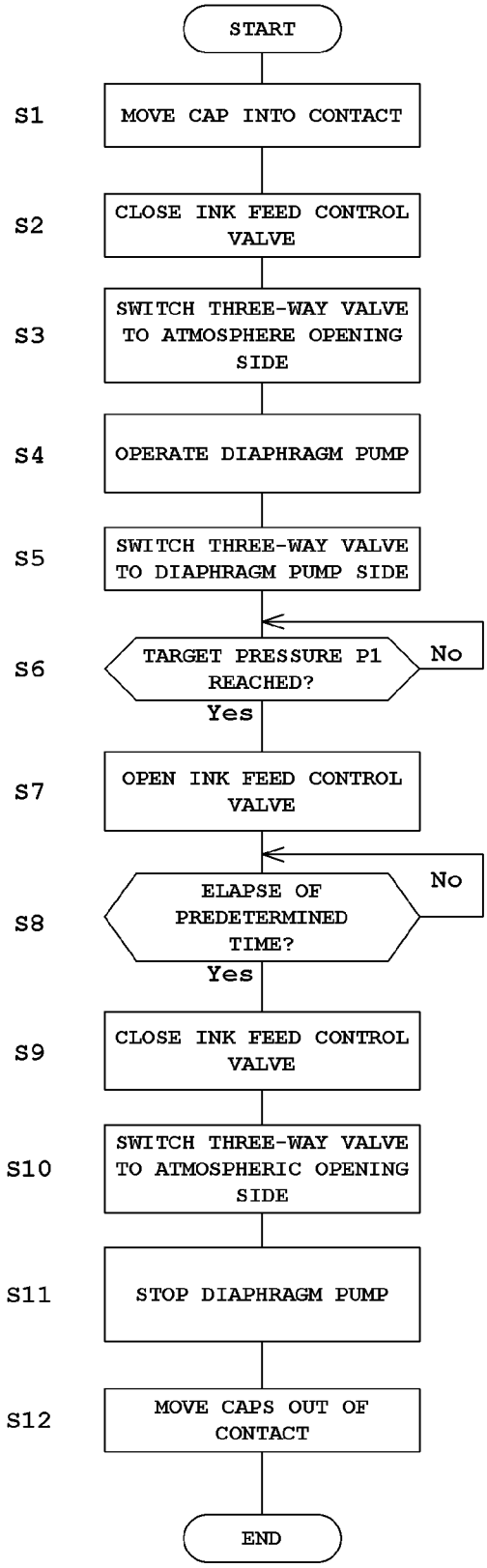
FIG. 4 is a flow chart showing a purging operation.

Next, an operation to purge the inkjet heads 19 in the above inkjet printing system will be described with reference to FIGS. 3 and 4. FIG. 3 is a graph showing pressure variations in caps. FIG. 4 is a flow chart showing a purging operation.

Step S1

The controller 45 operates the cap lifter 30 to move each cap 29 in the retracted position to the blocking position. Consequently, each inkjet head 19 will be in a state of the nozzles 21 being blocked off by each cap 29 from the ambient.

Step S2

The controller 45 closes the ink feed control valve 27. Consequently, each inkjet head 19 will have supply of the ink from the main ink tank 23 cut off, and become a state of only the side having the nozzles 21 open.

Step S3

The controller 45 switches the three-way valve 41 to the atmospheric opening side.

Step S4

The controller 45 operates the diaphragm pump 39. In this state, the diaphragm pump 39 only draws air from the atmospheric opening side, and does not contribute to decompression.

Steps S5 and S6

The controller 45 switches the three-way valve 41 to communicate with the diaphragm pump 39. Consequently, the diaphragm pump 39 begins to contribute to decompression. This corresponds to a point of time t1 in FIG. 3. Pressure P1 serving as a target for decompression (target pressure which is negative pressure) is about −50 kPa, for example. The controller 45 maintains this state until the pressure value from the pressure gauge 34 reaches the target pressure P1. The target pressure P1 is maintained from point of time t2 to point of time t3 in FIG. 3. During this period, the diaphragm pump 39 engages in pressure reduction to decompress the inside of each cap 21. However, since the ink feed control valve 27 is closed, ink in each inkjet head 19 is drawn toward each cap 29 but is not discharged from the inkjet head 19.

Steps S7 and S8

The controller 45 opens the ink feed control valve 27, and maintains this state until elapse of a predetermined time T1. This state continues from point of time t3 to point of time t4 in FIG. 3. The predetermined time T1 is a time taken until bubbles included in the ink remaining in the inkjet heads 19 are discharged therefrom. The predetermined time T1 is variable with the viscosity of the ink and flow path resistances of the feed pipe 25 and nozzles 21, and should preferably be set by taking these factors into account. More desirably, experiment is conducted beforehand to measure a time taken until the bubbles included in the ink are discharged, and the predetermined time T1 is set by adding an allowance to the time taken. Since the ink feed control valve 27 is opened, the ink in each inkjet head 19 is discharged to each cap 29 at a burst under strong negative pressure by choke suction. The purge using this choke suction will recover each nozzle 21 of the inkjet heads 19 from the non-discharge due to the bubbles and the like.

Step S9

The controller 45 closes the ink feed control valve 27. This state occurs at point of time t4 in FIG. 3. Consequently, the purge of the ink by choke suction is stopped.

Step S10

The controller 45 switches the three-way valve 41 from the diaphragm pump 39 to the atmospheric opening side. This corresponds to point of time t5 in FIG. 3. Since the leak valve 43 is provided on the atmospheric opening side from the three-way valve 41, the negative pressure is eliminated at low speed from point of time t5 to point of time t6. A time from point of time t5*a* with a dotted line to point of time t6 indicates an example of opening to the atmosphere directly without the leak valve 43. When opening to the atmosphere in a short time, there is a possibility of encountering an inconvenience in which the ink can be blown up inward from the caps 29 by a rapid influx of air. The apparatus in this embodiment avoids such an inconvenience by eliminating the negative pressure at low speed through the leak valve 43.

Steps S11 and S12

The controller 45 stops the diaphragm pump 39, and operates the cap lifter 30 to move each cap 29 in the blocking position to the retracted position.

According to the apparatus in this embodiment, as described above, the controller 45 closes the ink feed control valve 27 after moving the caps 29 into contact with the inkjet heads 19. After switching the three-way valve 41 to the atmosphere opening side, the controller 45 operates the diaphragm pump 39 and switches the three-way valve 41 to the caps 29 to decompress the insides of the caps 29. In this state, the ink is in the state of choke suction in which the negative pressure forces the ink toward the caps 29. When the ink feed control valve 27 is opened in this state, the ink will be discharged at a burst into the caps 29 along with bubbles. After closing the ink feed control valve 27 following the predetermined time, the three-way valve 41 is switched to the atmospheric opening side and the diaphragm pump 39 is stopped, thereby to return the insides of the caps 29 to atmospheric pressure. Then, the caps 29 are moved away from the inkjet heads 19. This series of operations is constituted mainly of operation timing of the ink feed control valve 27, three-way valve 41, and diaphragm pump 39, thereby realizing the choke suction with ease. Since the ink feed control valve 27 is closed upon lapse of the predetermined time T1 after ink discharge, a wasteful discharge of the ink can be inhibited and ink consumption can be reduced.

The apparatus in this embodiment includes one ink feed control valve 27 in the common portion of the feed pipe 25 communicating with each inkjet head 19, and controls opening and closing of this one ink feed control valve 27. If the ink feed control valve 27 were individually provided for each inkjet head 19, timing control of its opening and closing would become complicated. Moreover, a delay in closing any one of the ink feed control valves 27 at the time of negative pressure elimination, inks could flow from the other inkjet heads 19 back to the inkjet head 19 connected to that one feed control valve. This embodiment is free from such inconvenience.

This invention is not limited to the foregoing embodiment, but may be modified as follows:

(1) In the foregoing embodiment, decapping for separating the caps 29 from the inkjet heads 19 is carried out after eliminating the negative pressure. In what is called a one-pass apparatus, as in the apparatus in the foregoing embodiment, where the inkjet heads 19 do not move in the width direction of the web paper WP, the inkjet heads 19 are constructed long in the width direction. The above measure is taken in the foregoing embodiment because decapping is difficult unless the negative pressure is eliminated completely, as compared with a multipass apparatus in which the inkjet heads 19 move in the width direction. Therefore, in the case of the multipass apparatus, decapping may be carried out before the negative pressure is eliminated completely.

(2) The foregoing embodiment has been described taking for example the inkjet printing apparatus which does printing on the web paper WP in a roll form. However, this invention is not limited to such web paper WP, but is applicable also to inkjet printing apparatus for printing on various types of printing paper.

(3) The foregoing embodiment uses the three-way valve 41 as decompression control valve, and provides the leak valve 43 on the atmospheric opening side. This invention does not necessarily need the leak valve 43. The three-way valve 41 may be replaced with a combination of two switch valves.

(4) In the foregoing embodiment, the diaphragm pump 39 exemplifies the decompression device. The decompression device of this invention is not limited to the diaphragm pump 39. Other decompression devices include a tube pump, a rotary pump, and a diffusion pump, for example.

This invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for carrying out printing by moving an inkjet head and printing paper relative to each other, the inkjet head having a plurality of nozzles for discharging ink droplets, the apparatus comprising:

a feed pipe connected to each nozzle of the inkjet head for feeding ink thereto;

an ink feed control valve mounted on the feed pipe for controlling circulation of the ink;

a cap for blocking the plurality of nozzles of the inkjet head;

a decompression device for decompressing an inside of the cap;

decompression piping for connecting the cap and the decompression device;

a switching valve mounted on the decompression piping for controlling decompression by switching to and from communication between the cap and the decompression device and communication between the cap and atmosphere, the switching valve including a leak valve for returning the inside of the cap to atmospheric pressure at low speed when switching is made to the communication between the cap and atmosphere; and a control device configured to control the ink feed control valve, the cap, the decompression device and the switching valve;

wherein the control device is configured to move the cap into contact with the inkjet head to block all the nozzles of the inkjet head, then close the ink feed control valve, switch the switching valve to communication with atmosphere, operate the decompression device, thereafter switch the switching valve to communication with the cap to decompress the inside of the cap to a first pressure in a first predetermined time, open the ink feed control valve after the first pressure is reached, and further, when the inside of the cap has reached a second pressure which is between the first pressure and atmospheric pressure, upon lapse, after the ink feed control valve is opened, of a second predetermined time which is a time for enabling discharge of bubbles along with ink in view of flow paths and characteristics of the ink, the control device is configured to close the ink feed control valve, switch the switching valve to the communication with atmosphere for returning the inside of the cap to atmospheric pressure at low speed, thereafter stop the decompression device, and separate the cap from the inkjet head.

2. The inkjet printing apparatus according to claim 1, wherein:

the controller is configured to close the ink feed control valve upon lapse of a second predetermined time after the first predetermined time, and the second predetermined time is set, by taking characteristics of the ink and flow paths into account, to a time for allowing bubbles to be discharged along with the ink.

3. The inkjet printing apparatus according to claim 2, wherein the switching valve comprises a three-way valve.

4. The inkjet printing apparatus according to claim 1, wherein the inkjet head and the cap, respectively, are provided plurally, and the decompression piping has a plurality of purge branch pipes each connected at one end thereof to one of the caps, and an accumulator connected to the other end of each purge branch pipe and communicating with the decompression piping.

5. The inkjet printing apparatus according to claim 2, wherein the inkjet head and the cap, respectively, are provided plurally, and the decompression piping has a plurality of purge branch pipes each connected at one end thereof to one of the caps, and an accumulator connected to the other end of each purge branch pipe and communicating with the decompression piping.

6. The inkjet printing apparatus according to claim 3, wherein the inkjet head and the cap, respectively, are provided plurally, and the decompression piping has a plurality of purge branch pipes each connected at one end thereof to one of the caps, and an accumulator connected to the other end of each purge branch pipe and communicating with the decompression piping.

* * * * *